US012742283B2

(12) United States Patent
Stopp et al.

(10) Patent No.: US 12,742,283 B2
(45) Date of Patent: Sep. 22, 2026

(54) HEAT PRESS

(71) Applicant: Cricut, Inc., South Jordan, UT (US)

(72) Inventors: Grayson Stopp, San Francisco, CA (US); Thomas Crisp, Cottonwood Heights, UT (US); Lk Lin, Shenzen (CN); Carry Zhu, Xiamen (CN)

(73) Assignee: Cricut, Inc., South Jordan, UT (US)

( * ) Notice: Subject to any disclaimer, the term of this patent is extended or adjusted under 35 U.S.C. 154(b) by 0 days.

(21) Appl. No.: 18/954,385

(22) Filed: Nov. 20, 2024

(65) Prior Publication Data

US 2025/0075422 A1 Mar. 6, 2025

Related U.S. Application Data

(63) Continuation of application No. 18/500,850, filed on Nov. 2, 2023, now Pat. No. 12,152,338, which is a
(Continued)

(51) Int. Cl.
*D06F 75/36* (2006.01)
*D06F 75/26* (2006.01)
(Continued)

(52) U.S. Cl.
CPC ..... *D06F 75/36* (2013.01); *D06F 75/26* (2013.01); *D06F 75/34* (2013.01); *D06F 75/38* (2013.01)

(58) Field of Classification Search
CPC ..... D06F 75/36; D06F 75/26; D06F 75/34; D06F 75/38; D06F 75/24; D06F 93/005;
(Continued)

(56) References Cited

U.S. PATENT DOCUMENTS 629,801 A 8/1899 Meyer
644,472 A 2/1900 Segschneider
(Continued)

FOREIGN PATENT DOCUMENTS

CA 2751232 A1 9/2010
CA 3078005 A1 10/2020
(Continued)

OTHER PUBLICATIONS

Carole's Cricut Crafts: "The reception . . . ", YouTube. Link: <https://www.youtube.com/watch?v=Ni6ANCI3XIw>; , Jul. 31, 2017. "The reception . . . " (Year: 2017).
(Continued)

*Primary Examiner* — Uyen T Nguyen
(74) *Attorney, Agent, or Firm* — Honigman LLP; Grant Griffith

(57) ABSTRACT

A heat press including a body, a heat plate, a handle, a cover, a control compartment and an insulation portion. The body includes a first end and a second end. The heat plate is located proximate the first end of the body and is configured to engage ironable materials. The handle is located proximate the second end of the body and is configured to withstand forces from a user. The cover covers a portion of the body and the handle. The control compartment includes an electrical circuit, controls and a display. The control compartment is spaced away from and is at least indirectly electrically coupled to the heat plate. The insulation portion is positioned between the control compartment and the heat plate. The insulation portion includes a first layer of insulating material.

8 Claims, 11 Drawing Sheets

Related U.S. Application Data continuation of application No. 17/644,867, filed on Dec. 17, 2021, now Pat. No. 11,905,646, which is a continuation of application No. 16/952,360, filed on Nov. 19, 2020, now Pat. No. 11,208,758, which is a continuation of application No. 16/777,449, filed on Jan. 30, 2020, now Pat. No. 10,876,250, which is a continuation of application No. PCT/US2018/044799, filed on Aug. 1, 2018.

(60) Provisional application No. 62/540,021, filed on Aug. 1, 2017.

(51) Int. Cl.
*D06F 75/34* (2006.01)
*D06F 75/38* (2006.01)

(58) Field of Classification Search
CPC ..... B41F 16/0046; B41F 16/02; D06C 15/10; D06C 23/00
See application file for complete search history.

(56) References Cited

U.S. PATENT DOCUMENTS

| | | | |
|---|---|---|---|
| D32,831 | S | 6/1900 | Williams |
| 827,864 | A | 8/1906 | Hamill |
| 1,102,399 | A | 7/1914 | Eilau |
| 1,617,755 | A | 2/1927 | Gott |
| 1,749,667 | A | 3/1930 | Freedlein |
| 1,784,200 | A | 12/1930 | Piepenbring |
| 2,008,956 | A | 7/1935 | Heinz |
| 2,170,591 | A | 8/1939 | Holt |
| 2,186,663 | A | 1/1940 | Blount |
| 2,189,709 | A | 2/1940 | Deems |
| 2,343,555 | A | 3/1944 | Huffman |
| 2,626,733 | A | 1/1953 | Maxwell et al. |
| 2,632,969 | A | 3/1953 | Gerber |
| 2,637,125 | A | 5/1953 | Roberts |
| 2,643,699 | A | 6/1953 | Krueger |
| 2,655,333 | A | 10/1953 | Taylor |
| 2,700,236 | A | 1/1955 | Stanley et al. |
| 2,708,801 | A | 5/1955 | Voskresenski |
| 2,746,182 | A | 5/1956 | Schmitz |
| 2,829,452 | A | 4/1958 | Humphrey |
| 3,015,176 | A | 1/1962 | Freeman |
| 3,202,389 | A | 8/1965 | Zoffer |
| 3,308,566 | A | 3/1967 | Ivar et al. |
| 3,703,042 | A | 11/1972 | Smith |
| 3,916,546 | A | 11/1975 | Bullock et al. |
| 3,964,185 | A | 6/1976 | Bullock et al. |
| 4,117,612 | A | 10/1978 | Baumgartner et al. |
| 4,347,428 | A | 8/1982 | Conrad et al. |
| 4,379,018 | A | 4/1983 | Griesdorn |
| 4,455,473 | A | 6/1984 | Schwob |
| 4,523,079 | A | 6/1985 | Albinger, Jr. |
| 4,594,801 | A | 6/1986 | Gronwick et al. |
| 4,620,839 | A | 11/1986 | Moritoki et al. |
| 4,661,685 | A | 4/1987 | Contri |
| 4,686,352 | A | 8/1987 | Nawrot et al. |
| D293,952 | S | 1/1988 | Hsu |
| 4,727,240 | A | 2/1988 | Provolo et al. |
| 4,747,222 | A | 5/1988 | Riba |
| D300,479 | S | 3/1989 | Paulin |
| 4,918,845 | A | 4/1990 | Livecchi |
| 4,990,745 | A | 2/1991 | Bayles et al. |
| 5,010,664 | A | 4/1991 | Sakano et al. |
| 5,042,179 | A | 8/1991 | van der Meer |
| 5,252,171 | A | 10/1993 | Anderson et al. |
| D360,509 | S | 7/1995 | Maeda et al. |
| 5,435,883 | A | 7/1995 | Myers |
| 5,512,728 | A | 4/1996 | Jalbert |
| D393,118 | S | 3/1998 | Garrett et al. |
| 5,769,999 | A | 6/1998 | Anderson et al. |
| 5,854,466 | A | 12/1998 | Chou |
| 5,908,000 | A | 6/1999 | Spychalla et al. |
| 5,983,903 | A | 11/1999 | Nanba et al. |
| 6,035,777 | A | 3/2000 | King |
| 6,052,928 | A | 4/2000 | Lin |
| 6,054,690 | A | 4/2000 | Petit et al. |
| 6,104,009 | A | 8/2000 | Man |
| 6,172,335 | B1 | 1/2001 | Goodrich |
| 6,209,605 | B1 | 4/2001 | Lee et al. |
| 6,276,078 | B1 | 8/2001 | Beverly et al. |
| 6,396,027 | B1 | 5/2002 | Wu |
| 6,452,501 | B1 | 9/2002 | Tse et al. |
| 6,494,216 | B1 | 12/2002 | Hirata |
| 6,648,189 | B1 | 11/2003 | Minton et al. |
| 6,722,063 | B1 | 4/2004 | Uchikoshi |
| D546,517 | S | 7/2007 | Choi et al. |
| 7,610,701 | B2 | 11/2009 | Cavada |
| D610,763 | S | 2/2010 | Massip et al. |
| 7,926,208 | B2 | 4/2011 | Cavada |
| 7,980,433 | B2 | 7/2011 | Wynn |
| 8,089,030 | B2 | 1/2012 | Harrington et al. |
| D670,044 | S | 10/2012 | Andreesen |
| 8,539,700 | B2 | 9/2013 | Saba |
| 9,085,848 | B2 | 7/2015 | Crain et al. |
| 9,133,577 | B2 | 9/2015 | Fujimoto et al. |
| 9,289,960 | B2 | 3/2016 | Robinson et al. |
| 9,321,243 | B2 | 4/2016 | Fernando et al. |
| 9,334,604 | B1 | 5/2016 | Li |
| 9,553,442 | B2 | 1/2017 | Chou |
| 9,598,813 | B2 | 3/2017 | Mohankuma et al. |
| 9,687,038 | B2 | 6/2017 | Chae |
| 10,751,964 | B2 | 8/2020 | Galkin et al. |
| 10,876,250 | B2 | 12/2020 | Stopp et al. |
| 11,155,957 | B2 | 10/2021 | Alipour |
| D935,493 | S | 11/2021 | Cheng |
| 11,208,758 | B2 | 12/2021 | Stopp et al. |
| 2002/0020085 | A1 | 2/2002 | Kobayashi et al. |
| 2003/0094445 | A1 | 5/2003 | Alday Lesaga |
| 2003/0163935 | A1 | 9/2003 | Muljadi |
| 2004/0016348 | A1 | 1/2004 | Sharpe |
| 2004/0133295 | A1 | 7/2004 | Cohen et al. |
| 2005/0028408 | A1 | 2/2005 | Tobias et al. |
| 2006/0076341 | A1 | 4/2006 | Lozinski et al. |
| 2006/0081588 | A1 | 4/2006 | Bowser et al. |
| 2006/0086712 | A1 | 4/2006 | Feldmeier |
| 2006/0141884 | A1 | 6/2006 | Haque |
| 2006/0254097 | A1 | 11/2006 | Alipour |
| 2008/0235998 | A1 | 10/2008 | Yeung et al. |
| 2009/0165341 | A1 | 7/2009 | Janakiraman et al. |
| 2010/0236110 | A1 | 9/2010 | Lee |
| 2010/0313453 | A1 | 12/2010 | Pan et al. |
| 2011/0076079 | A1 | 3/2011 | Robinson |
| 2013/0186385 | A1 | 7/2013 | Choudhary et al. |
| 2015/0225889 | A1* | 8/2015 | Whitney ..... B65D 51/16 38/77.8 |
| 2015/0245723 | A1 | 9/2015 | Alexander |
| 2017/0167072 | A1 | 6/2017 | Wong et al. |
| 2017/0190069 | A1 | 7/2017 | Yamamoto |
| 2018/0030646 | A1* | 2/2018 | Kumar ..... D06F 43/002 |
| 2021/0337916 | A1 | 11/2021 | Robinson et al. |

FOREIGN PATENT DOCUMENTS

| | | | |
|---|---|---|---|
| CN | 2041320 | U | 7/1989 |
| CN | 2338364 | Y | 9/1999 |
| CN | 2529779 | Y | 1/2003 |
| CN | 2530971 | Y | 1/2003 |
| CN | 1420226 | A | 5/2003 |
| CN | 2615183 | Y | 5/2004 |
| CN | 1576449 | A | 2/2005 |
| CN | 2732486 | Y | 10/2005 |
| CN | 2760091 | Y | 2/2006 |
| CN | 2848913 | Y | 12/2006 |
| CN | 101037841 | A | 9/2007 |
| CN | 201006960 | Y | 1/2008 |
| CN | 201024341 | Y | 2/2008 |
| CN | 101160425 | A | 4/2008 |
| CN | 101443510 | A | 5/2009 |
| CN | 201626166 | U | 11/2010 |
| CN | 102154809 | A | 8/2011 |

(56) References Cited

FOREIGN PATENT DOCUMENTS

| | | | |
|---|---|---|---|
| CN | 102325937 | A | 1/2012 |
| CN | 202279981 | U | 6/2012 |
| CN | 202323519 | U | 7/2012 |
| CN | 102978888 | A | 3/2013 |
| CN | 202830589 | U | 3/2013 |
| CN | 203021832 | U | 6/2013 |
| CN | 103321029 | A | 9/2013 |
| CN | 203611556 | U | 5/2014 |
| CN | 203739398 | U | 7/2014 |
| CN | 203755057 | U | 8/2014 |
| CN | 203919979 | U | 11/2014 |
| CN | 204023262 | U | 12/2014 |
| CN | 104313860 | A | 1/2015 |
| CN | 205496726 | U | 8/2016 |
| CN | 205529605 | U | 8/2016 |
| CN | 205636267 | U | 10/2016 |
| CN | 106149338 | A | 11/2016 |
| CN | 106149339 | A | 11/2016 |
| CN | 205669143 | U | 11/2016 |
| CN | 106515204 | A | 3/2017 |
| CN | 106835658 | A | 6/2017 |
| CN | 106884302 | A | 6/2017 |
| CN | 206245107 | U | 6/2017 |
| CN | 206266934 | U | 6/2017 |
| CN | 106968097 | A | 7/2017 |
| CN | 206328613 | U | 7/2017 |
| CN | 107489011 | A | 12/2017 |
| CN | 108049141 | A | 5/2018 |
| CN | 108221331 | A | 6/2018 |
| CN | 109642392 | A | 4/2019 |
| CN | 110525023 | A | 12/2019 |
| DE | 7800810 | U1 | 6/1978 |
| DE | 2921062 | A1 | 12/1980 |
| DE | 4424333 | A1 | 1/1996 |
| EP | 0124039 | A1 | 11/1984 |
| EP | 2138628 | A1 | 12/2009 |
| EP | 2347631 | A1 | 7/2011 |
| EP | 2606761 | A1 | 6/2013 |
| EP | 2472000 | B1 | 8/2014 |
| EP | 3252227 | A1 | 12/2017 |
| EP | 2690215 | B1 | 5/2018 |
| FR | 1072531 | A | 9/1954 |
| GB | 195848 | A | 4/1923 |
| GB | 598978 | A | 3/1948 |
| GB | 622681 | A | 5/1949 |
| GB | 671057 | A | 4/1952 |
| GB | 792772 | A | 4/1958 |
| JP | 1983023595 | | 2/1983 |
| JP | 1983112587 | | 7/1983 |
| JP | 1985003835 | | 1/1985 |
| JP | 1990295598 | | 12/1990 |
| JP | 1994121899 | | 5/1994 |
| JP | 07299299 | | 11/1995 |
| JP | 1997091897 | | 10/1998 |
| JP | H10277295 | A | 10/1998 |
| JP | 3292149 | B2 | 6/2002 |
| JP | 2002166100 | A | 6/2002 |
| JP | 2004073607 | A | 3/2004 |
| JP | 2005029217 | A | 2/2005 |
| JP | 4308629 | B2 | 8/2009 |
| JP | 2011078615 | A | 4/2011 |
| JP | 2016185351 | A | 10/2016 |
| JP | 6166611 | B2 | 7/2017 |
| KR | 2019960001851 | | 2/1996 |
| KR | 200268681 | Y1 | 3/2002 |
| KR | 1020050096555 | | 10/2005 |
| KR | 100674480 | B1 | 1/2007 |
| KR | 100675979 | B1 | 1/2007 |
| KR | 2020100006005 | | 6/2010 |
| KR | 2020110007451 | | 7/2011 |
| KR | 101089242 | B1 | 11/2011 |
| KR | 101197712 | B1 | 8/2012 |
| KR | 1020120088515 | | 8/2012 |
| KR | 1020170060175 | | 5/2017 |
| TW | 83303021 | | 10/1994 |
| WO | 0019002 | A1 | 4/2000 |
| WO | 2008056993 | A2 | 5/2008 |
| WO | 2010109812 | A1 | 9/2010 |
| WO | 2012153242 | A2 | 11/2012 |
| WO | 2016038792 | A1 | 3/2016 |
| WO | 2019109411 | A1 | 6/2019 |
| WO | 2021034687 | A1 | 2/2021 |

OTHER PUBLICATIONS

Debbie O'Neal : "Live Help Decide What to Bring to Cricut Mountain Make a Thon", YouTube. Link: <https://www.youtube.com/live/8DrpBXQvGVo?si=1zwCouwVy9dWsKeZ>; , Jul. 20, 2017. (Year: 2017).

Ken's Kreations "Cricut EasyPress Reviews & Tips", Link: <https://kreativeken.blogspot.com/2018/02/cricut-easypress-review-tips.html>; Feb. 16, 2018. (Year: 2017).

Carole's Cricut Crafts: "The Easy Press in Action!", YouTube. Link: <https://www.youtube.com/watch?V=MzBoeS169nA>; , Aug. 1, 2017. (Year: 2017).

Coral + Co. Modern Sewing. "Cricut Mountain Makeathon 2017 and the new Cricut Maker". Link: <https://www.coralandco.com/blog/2017/8/cricut-mountain-makeathon-2017-and-thenew-cricut-maker.html>; Aug. 8, 2017. (Year: 2017).

Coastal Kelder. "Cricut Mountain Makeathon Recap". Link :<https://coastalkelder.com/2017/08/06/cricut-mountain-maker-recap/>; Aug. 6, 2017. (Year: 2017).

"Cricut Maker Live Event—Repost". YouTube. Link: <https://www.youtube.com/watch?v=8owYinYBKgY>; Cricut, Aug. 1, 2017. (Year: 2017).

Tanner Bell, Makers Gonna Learn. "Easy Press Unboxing, Cricut Maker Launch". YouTube. Link: <https://www.youtube.com/watch?v=vE29N3GYIIA>; , Aug. 1, 2017. (Year: 2017).

Heat Press Machine for T-Shirts. Amazon. Link: <https://www.amazon.com/dp/B0D1Y15V59?ref=ppx_yo2ov_dt_b_fed_asin_title>; Oct. 8, 2018. BetterSub.

BetterSub Mini Heat Press Machine Small Heat Press. Amazon. Link: < https://www.amazon.com/dp/B0D1Y3BHLV/ref=twister_B0DSFPZ5BL?_encoding=UTF8&th=1>;Oct. 8, 2018.

PowerPress Heat Press Machine. Amazon. Link: <https://www.amazon.com/PowerPress-HPM-0000-PK-Press-Machine-Portable-Pink/dp/B07GWLXHJ5/ref=sr_1_6?ascsubtag=cbq-ca-1339631561923899600-20&geniuslink=true&keywords=BLZK%2BEasy%2BHeat%2BPress%2BMachine&qid=1682351541&sr=8-6&ufe=app_do%3Aamzn1.fos.b06bdbbe-20fd-4ebc-88cf-fa04f1ca0da8&th=1>; Nov. 30, 2017.

W. Tillar Shugg, Handbook of Electrical and Electronic Insulating Materials, IEEE Press, Second Edition (Year: 1995).

International Search Report dated Nov. 23, 2018, relating to International Application No. PCT/US2018/044799.

European Search Report for European U.S. Appl. No. 18/821,978 dated Feb. 18, 2020.

Canadian Office Action for Application No. 3,028,673 dated Jul. 22, 2020.

Office Action for U.S. Appl. No. 16/777,449 dated Mar. 11, 2020.

Canadian Office Action for Application No. 3,028,673 dated Nov. 25, 2019.

IP Australia. Examination report No. relating to application No. 2022200753, dated Jan. 9, 2023.

International Search Report and Written Opinion for International Application No. PCT/US2020/046436, mailed Nov. 20, 2020, 11 pages.

International Search Report and Written Opinion for International Application N. PCT/US2023/063703, dated Jun. 19, 2023, 12 pages.

* cited by examiner

HEAT PRESS

CROSS REFERENCE TO PRIOR APPLICATIONS

This U.S. patent application is a continuation of, and claims priority under 35 U.S.C. § 120 from, U.S. patent application Ser. No. 18/500,850, filed on Nov. 2, 2023, which is a continuation of U.S. patent application Ser. No. 17/644,867, filed on Dec. 17, 2021, which is a continuation of U.S. patent application Ser. No. 16/952,360, filed on Nov. 19, 2020, now U.S. Pat. No. 11,208,758, which is a continuation of U.S. Patent Application 16,777,449, filed on Jan. 30, 2020, now U.S. Pat. No. 10,876,250, which is a continuation of International Application No. PCT/US2018/044799, filed on Aug. 1, 2018, which claims priority under 35 U.S.C. § 119 (e) from, U.S. Provisional Application 62/540,021, filed on Aug. 1, 2017. The disclosures of these prior applications are considered part of the disclosure of this application and are hereby incorporated by reference in their entireties.

TECHNICAL FIELD

This disclosure relates to a heat press.

BACKGROUND

Heat presses were developed as a means to adhere iron-on materials to fabric. For example, to heat print logos or lettering onto t-shirts, hats or blankets. Heat press developments over the years pertain to industrial presses, whereby the presses must be capable of withstanding mass production printing. These presses are large, unwieldy, unsafe, and made with expensive materials. Therefore, there remains a need for a safe and cost effective heat press which is capable of providing uniform, consistent and optimal heat in a home-use setting.

SUMMARY

One aspect of the disclosure provides a heat press including a body, a heat plate, a handle, a cover, a control compartment and an insulation portion. The body includes a first end and a second end. The heat plate is located proximate the first end of the body and is configured to engage ironable materials. The handle is located proximate the second end of the body and is configured to withstand forces from a user. The cover covers a portion of the body and the handle. The control compartment includes an electrical circuit, controls and a display. The control compartment is spaced away from and is communicatively coupled to the heat plate. The insulation portion is positioned between the control compartment and the heat plate. The insulation portion includes a first layer of insulating material.

Implementations of the disclosure may include one or more of the following optional features. In some implementations, the first layer of insulating material comprises glass fibers. In some examples, the insulation portion includes a second layer comprising glass reinforced nylon. The insulation portion may include a third layer of insulating material comprising glass fibers and also a fourth layer of insulating material comprising glass reinforced nylon. The second layer of insulating material thermally isolates the first layer of insulating material from the third layer of insulating material. The third layer of insulating material thermally isolates the second layer of insulating material from the fourth layer of insulating material.

In some configurations, the heat plate has a substantially square shape and includes a copper member at least partially embedded in an aluminum die-cast plate. The copper member has a serpentine geometry that includes a first portion and a second portion that are enantiomorphs. Furthermore, the heat plate includes at least one pressure point that limits the contact between the heat plate and the insulation portion.

In some examples, the cover is made of a thermoplastic and the handle includes a metal substrate at least partially enclosed by a plastic shell. The plastic shell forms a cavity for housing an electrical circuit at least indirectly electrically coupled to the heat plate and the control compartment. In some implementations, all of electrical components and controls are housed within the heat press and the metal substrate is in direct contact with only the fourth layer of insulating material.

Another aspect of the disclosure provides a heat press including a body, a heat plate, a control compartment, an insulation portion, a handle and a cover. The body includes a first end and a second end. The heat plate is located proximate the first end of the body and is configured to engage ironable materials. The control compartment includes an electrical circuit, controls and a display. The control compartment is spaced away from and is at least indirectly electrically coupled to the heat plate. The insulation portion is positioned between the control compartment and the heat plate. The insulation portion includes a first layer of insulating material. The handle includes a metal substrate and an electrical circuit communicatively coupled to the heat plate and the control compartment. The handle is located proximate the second end of the body and is configured to withstand forces from a user. The cover covers a portion of the body and the handle.

This aspect may include one or more of the following optional features. In some implementations, the first layer of insulating material comprises glass fibers. In some examples, the insulation portion includes a second layer comprising glass reinforced nylon.

In some configurations, the heat plate has a substantially square shape and includes a copper member at least partially embedded in an aluminum die-cast plate. In some examples, the cover is made of a thermoplastic and the handle includes a metal substrate and an electrical circuit communicatively coupled to the heat plate and the control compartment. In some implementations, all of electrical components and controls are housed within the heat press.

Another aspect of the disclosure provides a heat press including a body, a heat plate, a handle, a cover, a control compartment and an insulation portion. The heat plate includes a copper member at least partially embedded in an aluminum die-cast plate and is located proximate the first end of the body. The heat plate is configured to engage ironable materials. The handle is located proximate the second end of the body and is configured to withstand forces from a user. The cover covers a portion of the body and the handle. The control compartment includes an electrical circuit, controls and a display. The control compartment is spaced away from and is at least indirectly electrically coupled to the heat plate. The insulation portion is positioned between the control compartment and the heat plate. The insulation portion includes at least one layer of insulating material.

This aspect may include one or more of the following optional features. In some implementations, the handle includes a metal substrate and an electrical circuit communicatively coupled to the heat plate and control compartment. In some examples, all of the electrical components and controls are housed within the heat press.

The details of one or more implementations of the disclosure are set forth in the accompanying drawings and the description below. Other aspects, features, and advantages will be apparent from the description and drawings, and from the claims.

DESCRIPTION OF DRAWINGS

The disclosure will now be described, by way of example, with reference to the accompanying drawings, in which.

DETAILED DESCRIPTION

Figure 1:
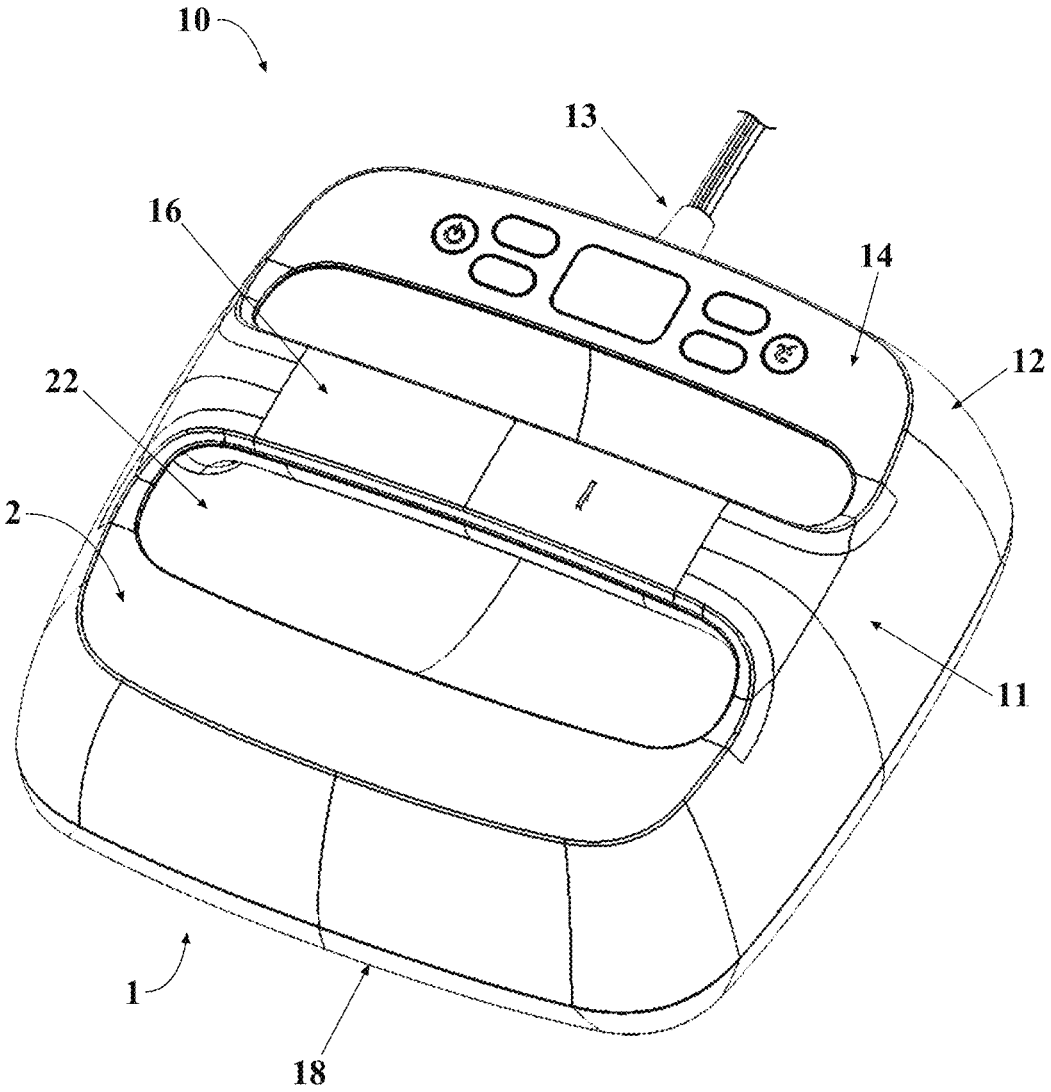
FIG. 1 is a perspective view of an example heat press.

Referring to FIG. 1, in some implementations, a heat press 10 includes a body 11, a cover 12, a handle 16, a control compartment 14, an electrical cord 13 and a heat plate 18. The body 11 has a first end 1 and a second end 2. The heat plate 18 is located proximate the first end 1 and the handle 16 is located proximate the second end 2.

In some examples, the cover 12 covers a portion of the body 11 and handle 16. The cover 12 is made of a thermoplastic with thermal resistance properties such as polycarbonate. The cover 12 forms an outer barrier of the heat press 10. The cover 12 shields the electrical components of the heat press 10. Additionally, the cover 12 protects a user of the heat press 10 from heat generated by the heat plate 18, whereby a user can safely touch the cover 12 during operation of the heat press 10.

Figure 2:
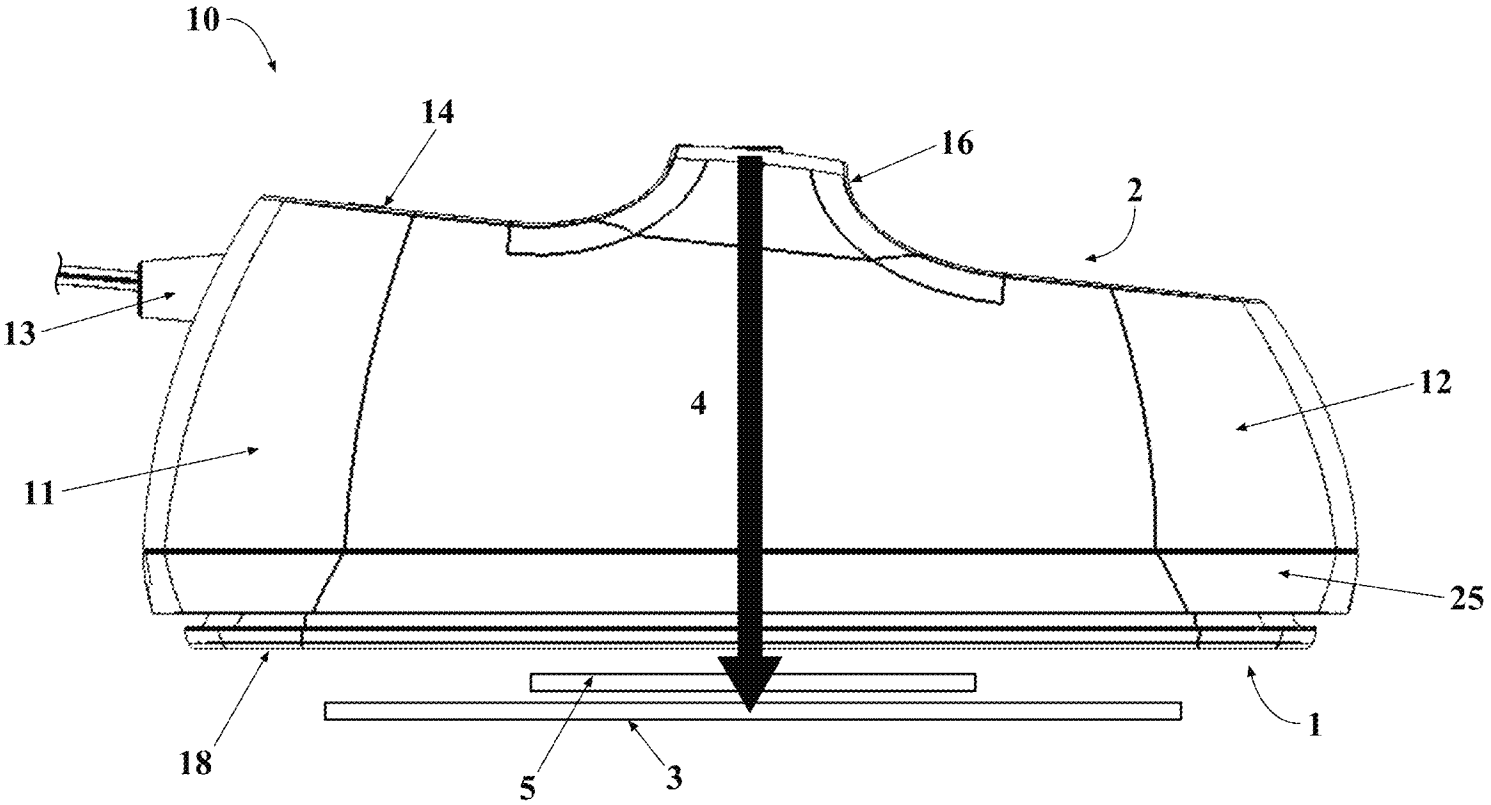
FIG. 2 is a side view of an example heat press.

Referring to FIG. 2, in some implementations a heat press 10 includes a heat plate 18 configured to engage ironable materials 3, such as cotton, nylon, polyester, silk, wool and various other fabrics. A user of the heat press 10 desires to adhere, for example, a logo, picture or print onto the ironable materials 3. For example, a user may want to adhere a logo or print onto a t-shirt, whereby the logo or print is on transfer paper and after the transfer paper and t-shirt are heated in unison for a duration of time, the logo will adhere to the t-shirt.

In some examples, once the heat plate 18 reaches its desired temperature, a user places the heat press 10 on top of a transfer paper logo 5 and ironable material 3, whereby the transfer paper logo 5 is positioned between the ironable material 3 and the heat plate 18. Subsequently, the user applies a downward force 4 onto the handle 16 which compresses the heat plate 18, transfer paper logo 5 and ironable material 3. The force 4 is applied for 1 to 60 seconds. Following, the heat press 10 is removed and the user is left with the transfer paper logo 5 adhered to the ironable material 3.

In some configurations, the heat press 10 includes an insulation portion 25 positioned between the heat plate 18 and control compartment 14. The heat press 10 is configured to be used in a household setting, thereby movability is critical to its design. All of the heat press's 10 electrical components and controls 19 are housed within the heat press 10. The insulation portion 25 provides protection to the user of the heat press 10 and also the electrical components and controls 19 from the high temperatures generated by the heat plate 18.

Figure 3:
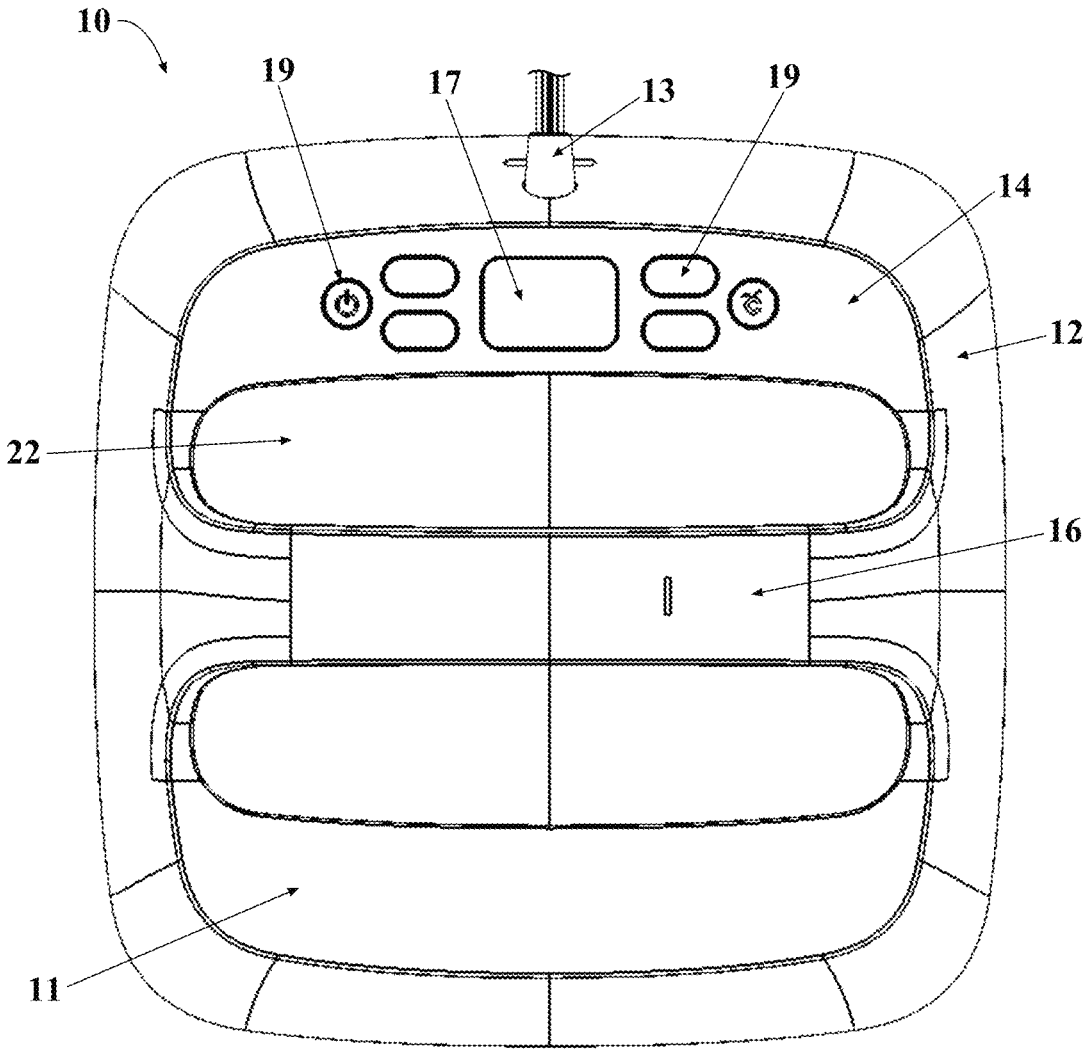
FIG. 3 is a top view of an example heat press.

Referring to FIG. 3, in some configurations, the heat press 10 includes a control compartment 14 having a plurality of controls 19 and a display 17. The controls 19 are at least indirectly electrically coupled to the display 17 and heat plate 18. The controls 19 allow the user to set the operation settings of the heat press 10, such as the temperature of the heat plate 18 and the duration of time the heat plate 18 is heated. The display 17 shows the operating settings of the heat press 10.

Additionally, the heat press 10 includes a user hand clearance area 22. The user hand clearance area 22 is located beneath the handle 16. The user hand clearance area 22 provides the user with adequate clearance to firmly grab the handle 16.

Figure 4:
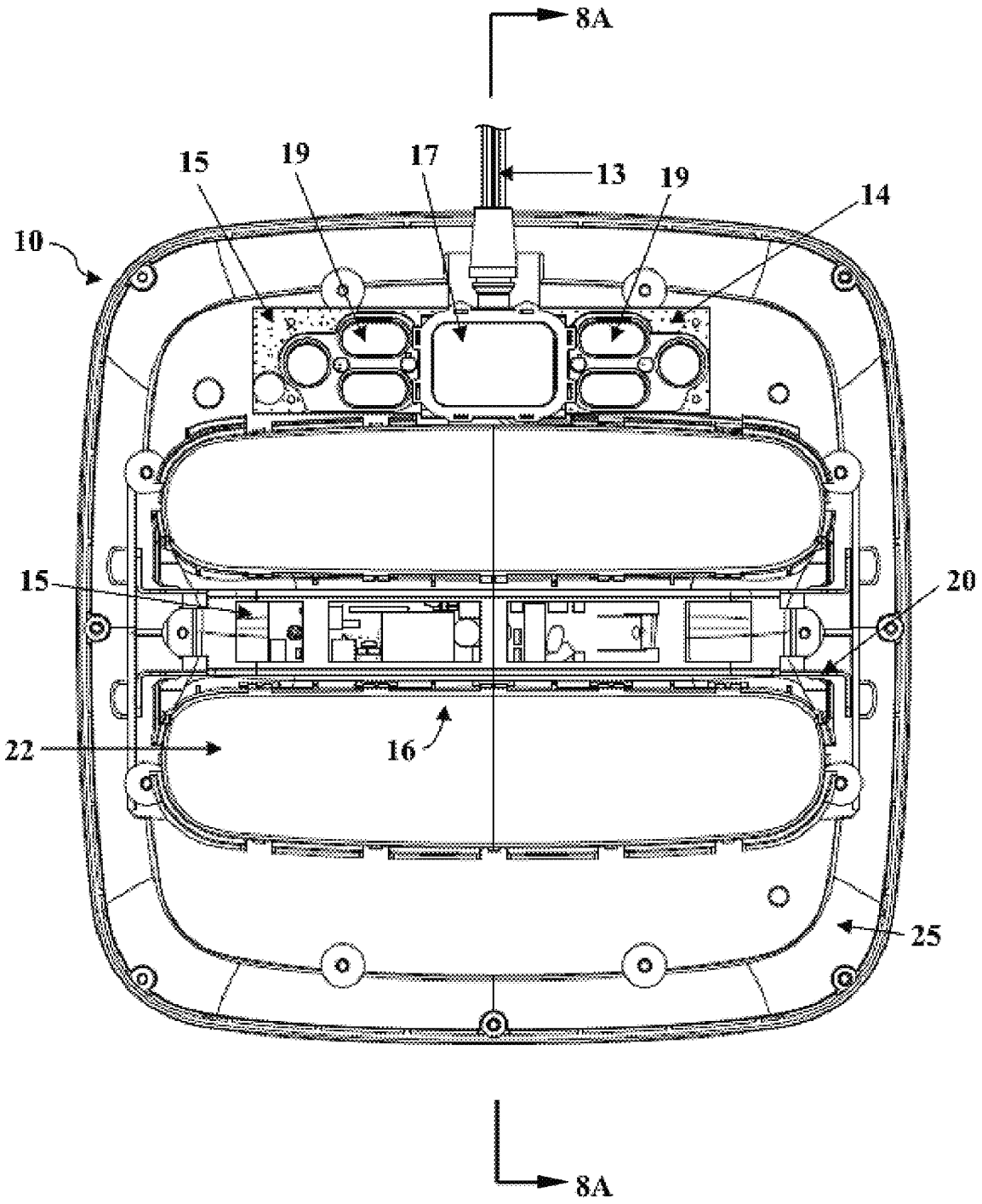
FIG. 4 is a top view of an example heat press without a cover.
Figure 5:
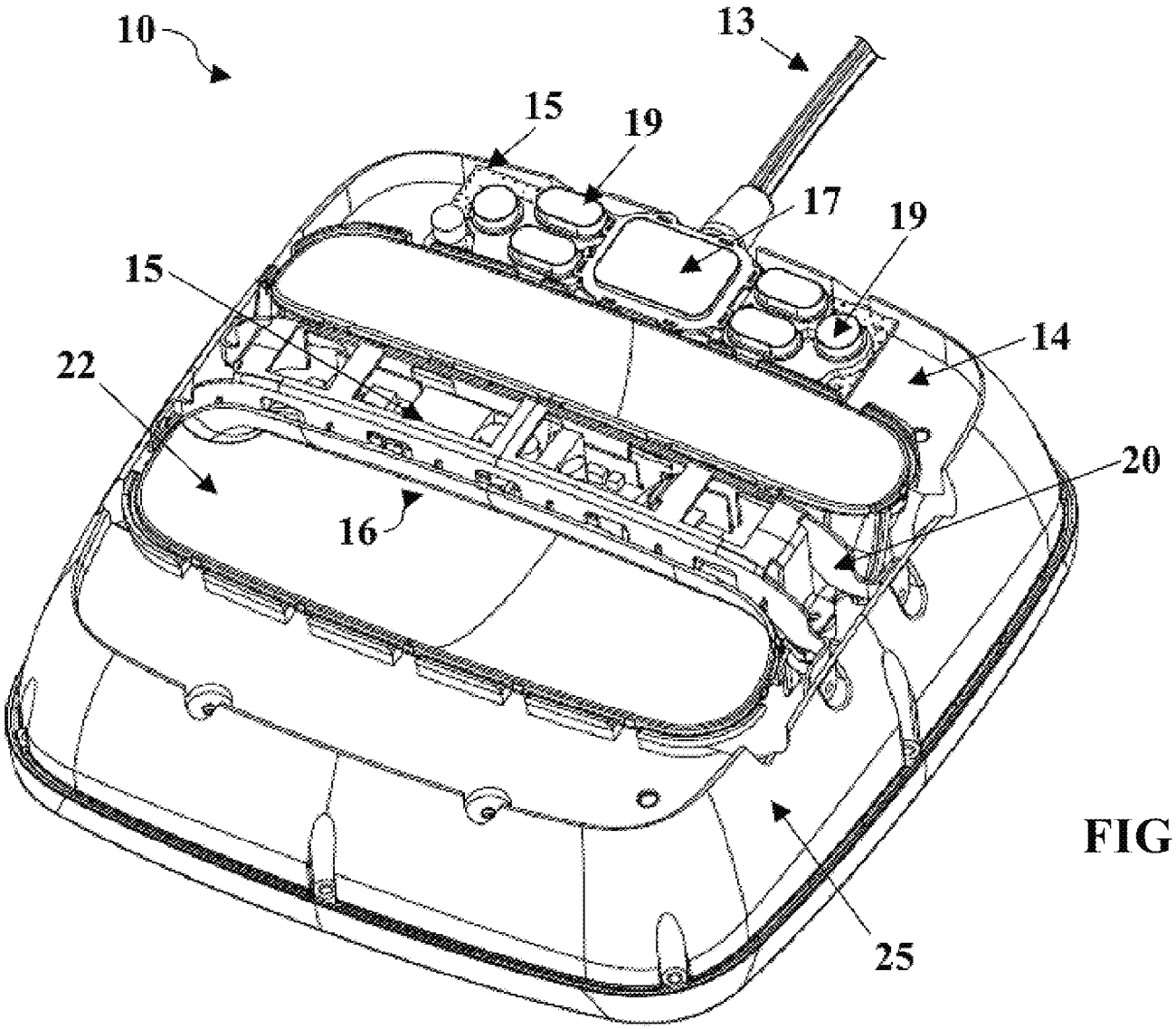
FIG. 5 is a perspective view of an example heat press without a cover.

Now referring to FIG. 4 and FIG. 5, the heat press 10 is shown without its cover 12. In some implementations, the heat press 10 includes at least one electrical circuit 15. The at least one electrical circuit 15 is configured to receive electrical power from a power source via an electrical cord 13. The power source may originate from an external permanent source, e.g. wall socket.

In some examples, the heat press 10 has an electrical circuit 15 located within the control compartment 14 and another located with the handle 16. The electrical circuits 15 are at least indirectly electrically coupled to one another and also to the heat plate 18, controls 19 and display 17. The electrical circuits 15 are configured to include an arrangement of capacitors, resistors, inductors, integral signal and power traces and connections.

Moreover, the at least one electrical circuit 15 includes a processor, memory and software that effectively operate the heat press 10. In some examples, the at least one electrical circuit 15 are configured to include safety features. For example, upon the occurrence of the heat plate 18 reaching a temperature set by the user, the electrical circuit 15 will adjust the behavior of the heat plate 18 to maintain its temperature in order to avoid overheating and damage to the ironable materials 3. Additionally, if the heat plate 18 is heated for a duration of time, for example 30 minutes, the electrical circuit 15 will initiate a safety feature to automatically turn off the heat plate 18.

In some examples, the heat press 10 includes a metal substrate 20 located within the handle 16. In order to keep the heat press's 10 weight at a minimum, a majority of its components are made of plastic or thermoplastic. The metal substrate 20 provides the handle 16 support in order to withstand forces from the user.

Figure 6:
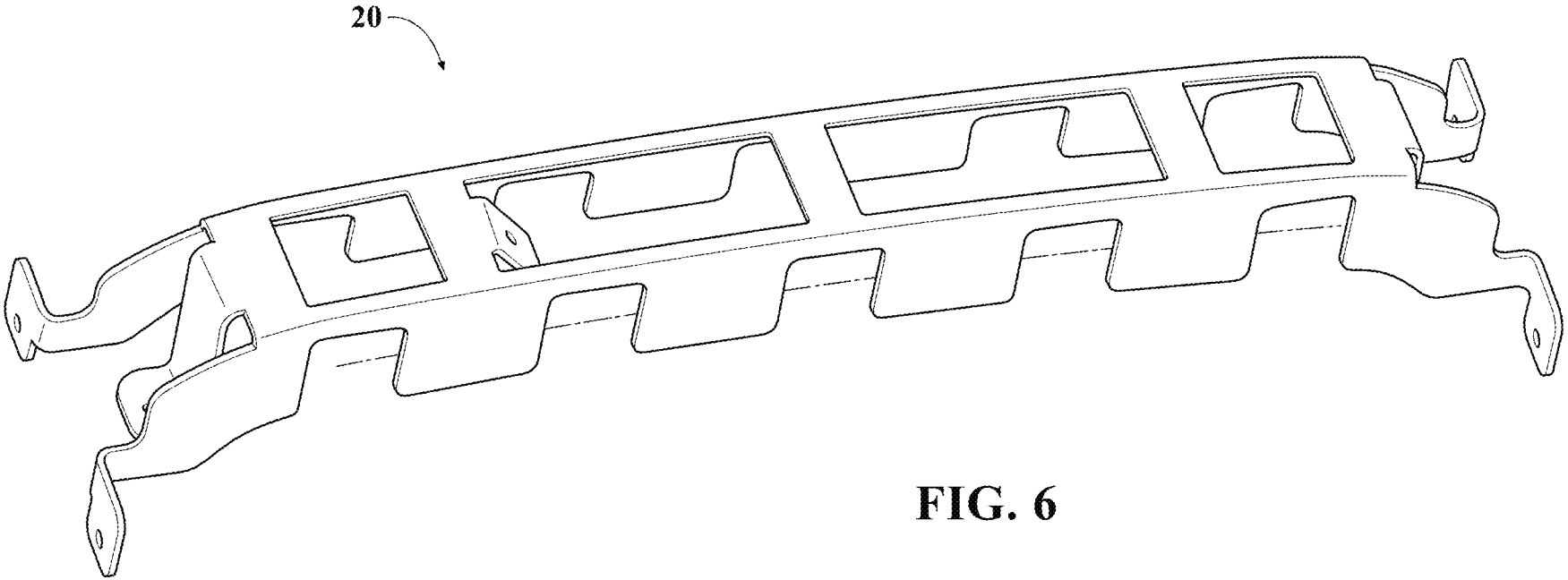
FIG. 6 is a perspective view of an example metal substrate of a handle.

FIG. 6 shows an example metal substrate 20. The ends of the metal substrate 20 are fastened to the body 11 of the heat press, more specifically, to the insulation portion 25. The metal substrate 20 is made from sheet metal, such as aluminum or steel.

Figure 7:
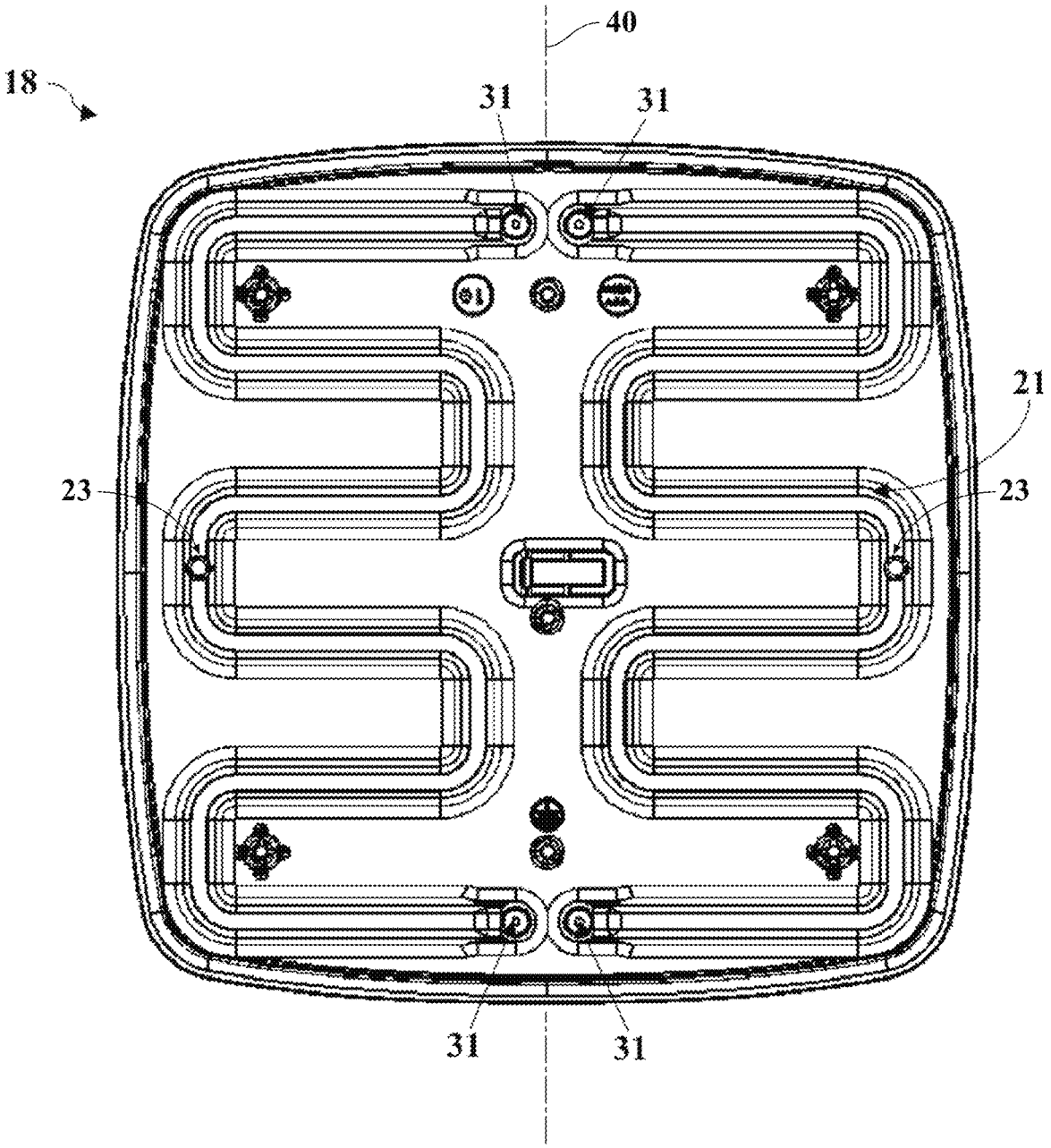
FIG. 7 is bottom view of an example heat plate.

Now referring to FIG. 7, an example heat plate 18 is shown. The heat plate 18 includes copper members 21 and a plurality of pressure receiving points 23. The heat plate 18 is configured to heat uniformly and at temperatures ranging from 0 to 400 degrees Fahrenheit. The size of the heat plate 18 can vary depending on the application, however the size is larger than a household iron. The shape of the heat plate 18 is substantially square or rectangular, however the shape can also vary depending on the application.

In some configurations, the heat plate 18 includes two copper members 21. The materials and layout of the copper members 21 are critical to the heat plate's 18 ability to heat consistently and uniformly. The copper members 21 have a serpentine geometry. In some examples, the copper members 21 have a mirrored image layout, wherein the copper members 21 are separated by a longitudinal axis 40 located proximate to the midpoint of the heat plate 18. Moreover, if the copper member 21 on the right side of axis 40 is folded over the longitudinal axis 40 onto the copper member 21 on the left side of the axis 40, the layouts of the copper member 21 will be the same. Additionally, the copper members 21 are at least partially embedded in an aluminum die-cast plate 32. Furthermore, the copper members 21 include heating elements 31. The heating elements 31 are located at the ends of each copper member 21. The heating elements 31 are configured to receive electrical power and to heat the copper members 21.

Figure 8A:
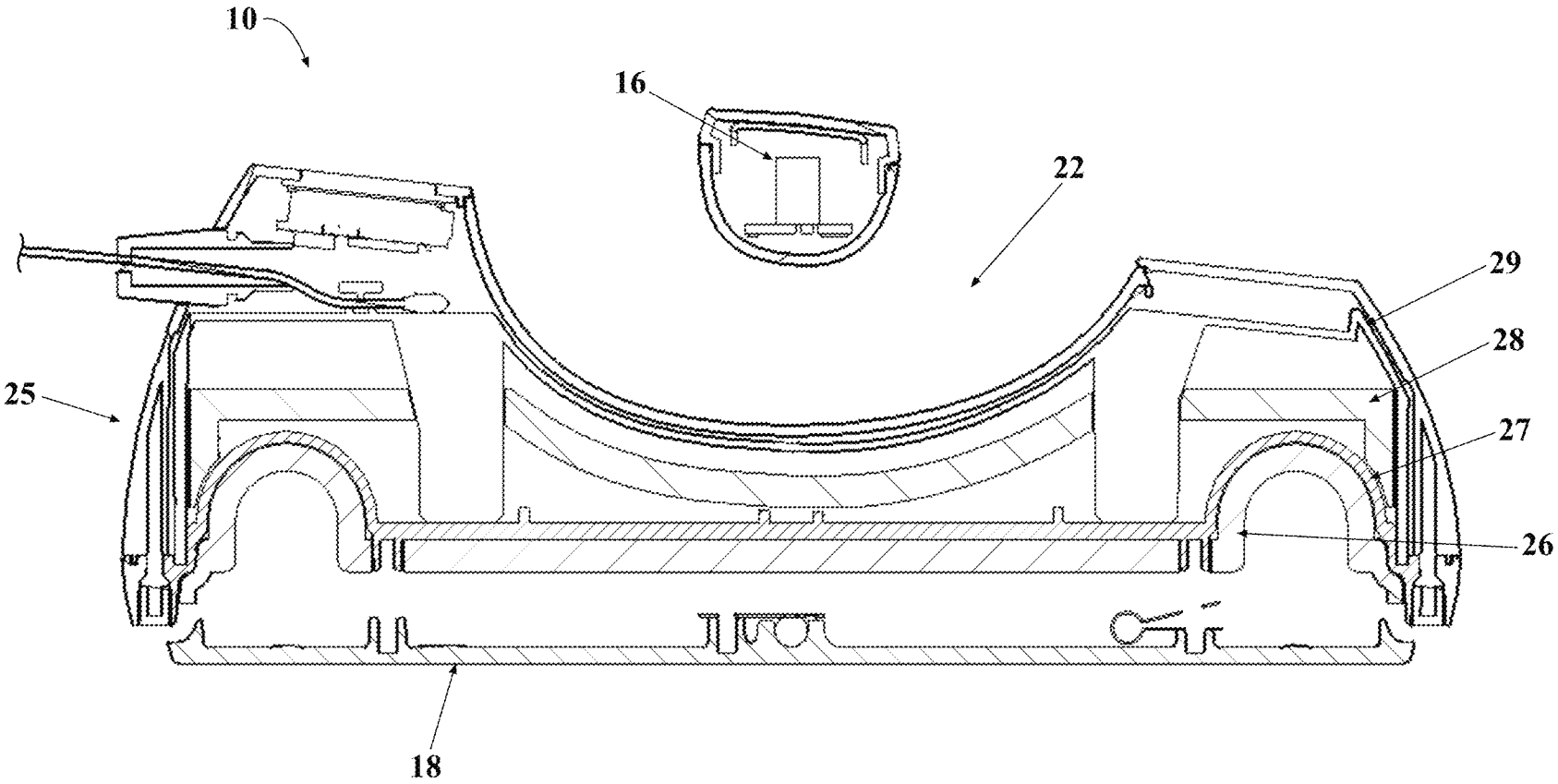
FIG. 8A is a partial cross-sectional view taken through line 8A-8A of FIG. 4.

Now referring to FIG. 8A, in some implementations, the heat press 10 includes an insulation portion 25 that has a first layer of insulating material 26. The insulation portion 25 provides protection to the user of the heat press 10 and also the electrical components and controls from the high temperatures generated by the heat plate 18. The insulation portion 25 allows the electrical components and controls to be housed within the heat press 10 and not located externally, like in many industrial presses.

In some examples, the insulation portion 25 includes multiple layers of insulation with thermal resistance properties. The layers are thermally isolated from one another. For example, the insulation portion 25 includes a first layer of insulating material 26 comprising a microporous material including glass fibers and a second layer of insulating material 27 comprising glass reinforced nylon, such as 85% Nylon, 15% glass fiber. Furthermore, the insulation portion 25 may include a third layer of insulating material 28 comprising a microporous material including glass fibers and a fourth layer of insulating material 29 comprising glass reinforced nylon, such as 85% Nylon, 15% glass fiber. Each of the layers that comprise the insulation portion 25 are 0 to 15 millimeters thick.

Figure 8B:
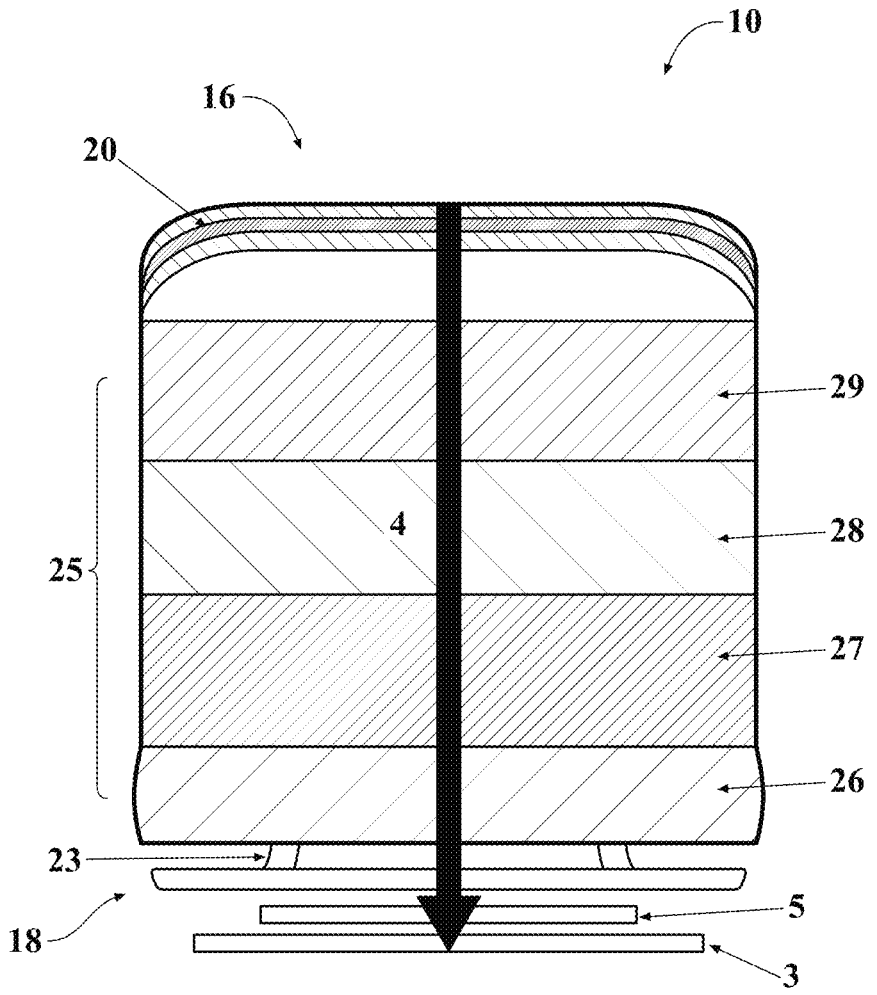
FIG. 8B is a schematic depiction of the insulation layers of an example heat press.

Now referring to FIG. 8B, in some configurations the insulation portion 25 allows the heat plate 18 to provide uniform pressure to the example transfer paper logo 5 and ironable material 3. Uniform pressure aids the adherence of the example transfer paper logo 5 to the ironable material 3. For example, the user can grab the handle 16 including the metal substrate 20 and apply a downward force 4. The force 4 will transfer through the layers of the insulation portion 25 which include the fourth layer of insulating material 29, the third layer of insulating material 28, the second layer of insulating material 27 and the first layer of insulating material 26. In some examples, the metal substrate 20 is in direct contact with only the fourth layer of insulating material 29. Subsequently, the force 4 transfers from the insulation portion 25 through the heat plate pressure points 23 to the heat plate 18. The pressure points 23 also limit the contact of the heat plate 18 and the insulation portion 25, in order to limit heat transfer from the heat plate 18. Ultimately, the force pushes the example transfer paper logo 5 onto the ironable material 3.

Figure 9:
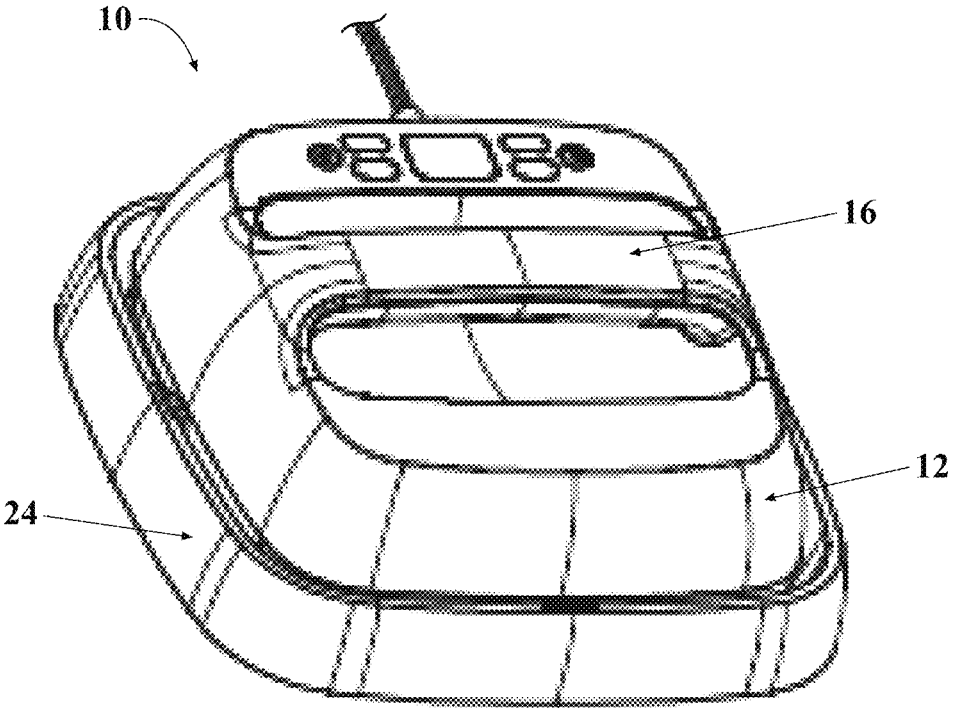
FIG. 9 is a perspective view of an example heat press engaged with an example heat press stand.
Figure 10:
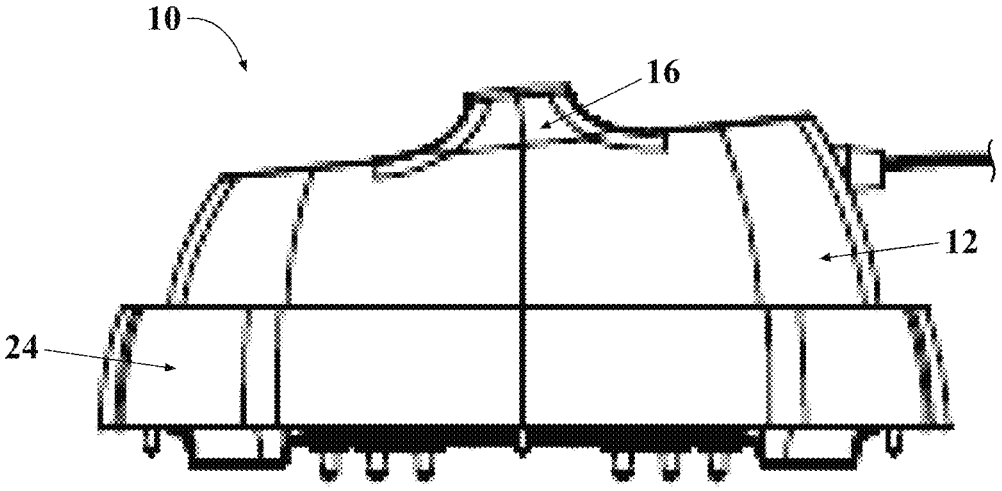
FIG. 10 is a side view of an example heat press engaged with an example heat press stand.

Referring to FIG. 9 and FIG. 10, in some implementations, the heat press 10 includes an additional safety feature a heat press stand 24. The heat press stand 24 further helps prevent the user from getting burned by the high temperatures of the heat plate 18. The heat press stand 24 is configured to have minimal touchpoints with the heat plate 18, this allows the heat from the heat plate 18 not to transfer to the heat plate stand 24 so a user can safely touch the heat plate stand 24 while the heat press 10 is in use. Moreover, the heat press 10 can be safely engaged with the heat press stand 10 while the heat plate 18 is reaching its set temperature. Additionally, the heat press 10 can be placed back into the heat plate stand 24, after its use, to allow the heat plate 18 to safely cool down.

Figure 11:
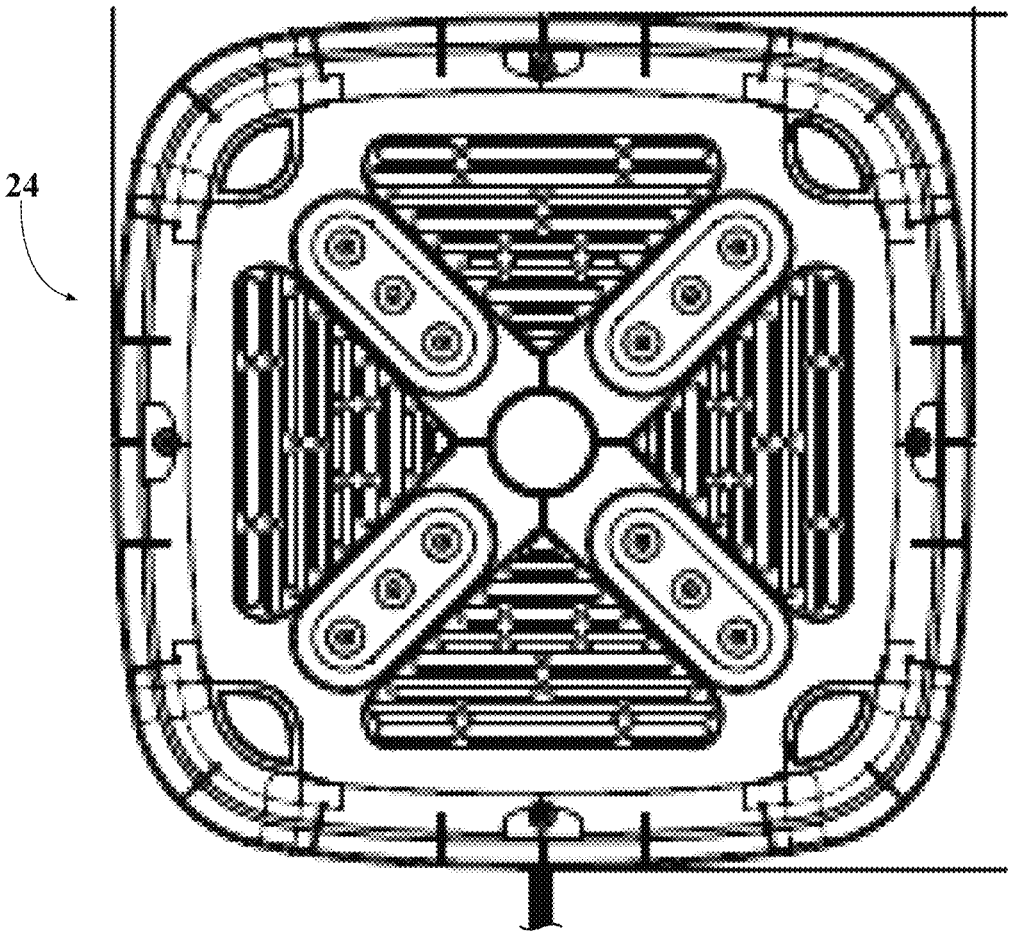
FIG. 11 is a top view of an example heat press stand.

In FIG. 11, the top of an example heat press stand 24 is shown. The heat press is configured to have minimal touchpoints with the heat press stand 24 and is made from materials with thermal resistance properties such as silicon and glass reinforced nylon.

A number of implementations have been described. Nevertheless, it will be understood that various modifications may be made without departing from the spirit and scope of the disclosure. Accordingly, other implementations are within the scope of the following claims. For example, the actions recited in the claims can be performed in a different order and still achieve desirable results.

What is claimed is:

1. A heat press comprising:

a body having a first end and a second end opposite the first end;

a heat plate located at the first end of the body;

a handle forming a portion of the second end of the body, the second end of the body defining a concave depression over and across which the handle extends; and a control compartment, a display, and user controls coupled to the body;

wherein:

a perimeter of the concave depression comprises a first lateral edge, a second lateral edge opposite the first lateral edge, a front edge, and a rear edge opposite the front edge;

the perimeter of the concave depression comprises the first lateral edge connected to the front edge connected to the second lateral edge connected to the rear edge connected to the first lateral edge;

the handle extends in a lateral direction between the first lateral edge of the perimeter of the concave depression and the second lateral edge of the perimeter of the concave depression;

the display and the user controls are situated adjacent the front edge of the perimeter of the concave depression; and a plane extending perpendicular to the heat plate and bisecting the handle along a longitudinal axis of the handle is offset from the control compartment, the display, and the user controls such that the plane does not intersect the control compartment, the display, nor the user controls.

2. The heat press of claim 1, wherein the concave depression comprises a curved surface that extends downward from the perimeter of the concave depression toward the first end of the body.

3. The heat press of claim 2, wherein the curved surface is curved about more than a single axis.

4. The heat press of claim 1, wherein the display and the user controls face away from the first end of the body.

5. The heat press of claim 1, further comprising an insulation portion positioned between the first end of the body and the concave depression.

6. The heat press of claim 5, wherein the insulation portion is positioned within the body between the heat plate and the concave depression.

7. The heat press of claim 1, wherein the control compartment disposed within the body, and wherein the display and the user controls are coupled to the control compartment.

8. The heat press of claim 7, wherein the control compartment, the display, and the user controls are not located on the handle and are not located in the concave depression.

* * * * *